US005361417A

United States Patent [19]

Watanabe

[11] Patent Number: 5,361,417

[45] Date of Patent: Nov. 8, 1994

[54] TROUSERS WITH ADHERED CREASES

[75] Inventor: Tatsuo Watanabe, Nagoya, Japan

[73] Assignee: Nikko Wool Textile Co., Ltd., Japan

[21] Appl. No.: 165,469

[22] Filed: Dec. 13, 1993

[30] Foreign Application Priority Data

Sep. 21, 1993 [JP] Japan ..... 5-051238[U]

[51] Int. Cl.[5] ..... A41D 1/06

[52] U.S. Cl. ..... 2/227; 2/231; 2/233; 2/255

[58] Field of Search ..... 2/227, 228, 79, 231, 2/233, 274, 275, 255, 258; 38/1 B, 75, 70, 94; 223/28, 29

[56] References Cited

U.S. PATENT DOCUMENTS

| | | | |
|---|---|---|---|
| 730,741 | 6/1903 | Buswell | 2/231 |
| 751,741 | 2/1904 | Lyons | 2/231 |
| 979,780 | 2/1910 | Marinsky | 2/231 |
| 2,005,480 | 6/1935 | Segelin et al. | 2/231 |
| 2,253,732 | 8/1941 | Segelin et al. | 2/231 |
| 2,288,212 | 6/1942 | Segelin et al. | 2/231 |
| 3,268,915 | 8/1966 | Warnock et al. | 2/227 |

FOREIGN PATENT DOCUMENTS

| | | | |
|---|---|---|---|
| 414068 | 5/1925 | Germany | 2/231 |
| 556451 | 8/1932 | Germany | 2/231 |
| 2421518 | 11/1975 | Germany | 2/227 |
| 302764 | 11/1932 | Italy | 2/231 |

*Primary Examiner*—Clifford D. Crowder
*Assistant Examiner*—Gloria Hale
*Attorney, Agent, or Firm*—Parkhurst, Wendel & Rossi

[57] ABSTRACT

A pair of trousers including two leg coverings for covering two legs of a wearer, respectively, each of the leg coverings including a front and a rear half, one or both of the front and rear halves having a crease line extending over a vertical length thereof, and two side portions extending along the crease line on both sides of the crease line, respectively; and one or more adhesive tapes which connect respective inner surfaces of the side portions to each other over an entire length of the side portions along the crease line, so as to prevent the side portions from opening in a direction in which the side portions become more distant.

6 Claims, 3 Drawing Sheets

TROUSERS WITH ADHERED CREASES

BACKGROUND OF THE INVENTION

1. Field of the Invention

The present invention relates to a pair of trousers and particularly to such trousers which has creases, or crease lines on the top of the creases, which have excellent durability and are maintained sufficiently neat for a long time of use.

2. Related Art Statement

Generally, a pair of trousers has creases, or crease lines on the top of the creases, which are set by, e.g., steaming in at least the front and rear halves of each of the two leg coverings thereof. The creases or crease lines ensure that a wearer can always fold the trousers in the same fashion, thereby preventing the trousers from having undesirable wrinkles and/or becoming out of shape. These are technical advantages with the creases or crease lines set in the trousers. Additionally, the creases or crease lines give a straight silhouette to the trousers when the trousers are being worn on the wearer, thereby improving the visual appearance of the trousers. This is an aesthetic advantage with the creases or crease lines.

However, since the creases or crease lines are created simply by folding the fabric of the trousers, they "erase" little by little as the trousers is worn again and again. Specifically, while the trousers are worn on the wearer, tensile forces are exerted to the creases or crease lines in various directions because of physical motions of the wearer. Some of the tensile forces are exerted to the creases in directions in which to unfold or open the creases and thereby "erase" the crease lines on the top of the creases.

For keeping the creases or crease lines sufficiently neat in the trousers, it has conventionally been practiced to frequently iron the trousers at home. However, the ironing of the trousers is very cumbersome and time-consuming and furthermore it may deteriorate the fabric of the trousers.

In the above-described background, there have been various proposals to keep the creases in shape or the crease lines sufficiently neat in the trousers for a long period of use, without needing to frequently iron the trousers, and some of those proposals have been reduced to practice. One of such proposals is to sew trousers using a fabric produced by weaving a yarn made of wool mixed with polyester fiber. In this case, by utilizing the thermal plasticity of the polyester fiber, durable creases or crease lines are thermally set in the trousers. Meanwhile, in the case of trousers made purely of wool, the "CSIRO-set" process has generally been employed. In this process, an appropriate chemical agent or agents is/are applied to, or sprayed toward, the back or inner surfaces of creases and subsequently the creases are subjected to steaming, so as to improve the durability of the creases set in the wool trousers.

However, none of the known proposals has solved the above-mentioned problem to a satisfactory extent because the creases or crease lines set in the trousers according to any of the proposals are not effectively prevented from opening widely due to the tensile forces exerted thereto by the physical motions of the wearer while the trousers are worn on the wearer. Additionally, since the fabric used for sewing the trousers is produced by weaving warps and wefts, it has the property of restoring the creases to their basic forms, i.e., flat forms. For those reasons, it is very difficult to keep the creases in shape or the crease lines sufficiently neat in the trousers for a long time of use.

Stated differently, the creases or crease lines set in the trousers according to the conventional processes "erase" little by little during continued wearing of the trousers. The conventional processes suffer from additional disadvantages. First, those proposals are not versatile with respect to sorts of fabrics or sorts of yarns used for producing the fabrics, that is, are limited to specified fabrics or yarns. Second, in the case where the "CSIRO-set" process is employed for setting creases or crease lines in trousers, the overall production process is complicated because of use of one or more chemical agents. Additionally, some of those chemical agents react with a dye used for dying the fabric of the trousers, thereby discoloring the trousers. Thus, the use of the conventional process is limited to such fabrics dyed using specific dyes.

Meanwhile, it could be said that connecting, by stitching with thread, between two side portions on both sides of a crease line in trousers over the entire length of the side portions will prevent the crease line from opening widely due to the tensile forces exerted thereto. In this case, however, the stitches sewn into the side portions are exposed on the outside surface of the trousers, thereby worsening the outside appearance of the trousers and accordingly reducing the commercial value of the trousers. Thus, this method is not satisfactory, either.

SUMMARY OF THE INVENTION

It is therefore an object of the present invention to provide a pair of trousers having creases which do not open widely due to the tensile forces exerted thereto by the physical motions of a wearer so that crease lines on the top of the creases enjoy improved durability and accordingly are kept sufficiently neat for a longer period of use.

It is another object of the present invention to provide a pair of trousers in which durable creases or crease lines are easily set without being limited to such fabrics produced with specific yarns and/or dyes.

The above objects have been achieved by the present invention, which provides a pair of trousers comprising two leg coverings adapted to cover two legs of a wearer, respectively, each of the leg coverings including a front and a rear half, at least one of the front and rear halves having a crease line extending over a vertical length thereof, and two side portions extending along the crease line on both sides of the crease line, respectively; and at least one adhesive tape which connects respective inner surfaces of the side portions to each other over an entire length of the side portions along the crease line, so as to prevent the side portions from opening in a direction in which the side portions become more distant.

In the trousers arranged as described above, one or more adhesive tapes connect between the respective inner surfaces of the two side portions on both sides of a crease line, so as to prevent the two side portions from unfolding or opening in a direction in which the two side portions are separated from each other or the distance between the two side portions are increased. Thus, the crease defined by the two side portions are effectively prevented from opening widely due to the tensile forces exerted thereto while the trousers are worn on a wearer. That is, the crease is kept unchanged, i.e., sufficiently neat for a long period of use. So long as the connection of the two side portions are not broken, the crease is kept neat.

Thus, in the present trousers, the crease lines are kept in good shape for a longer time. Therefore, the present trousers do not need the frequent ironing at home that has conventionally been necessary for that purpose, thereby releasing the user from the cumbersome and time-consuming work. Additionally, the present trousers are free from the problem that the fabric of the trousers may be deteriorated because of the frequent ironing.

Furthermore, in the present trousers, such durable crease lines are easily created by adhering, using one or more adhesive tapes, the two side portions adjacent each of the crease lines. Thus, the present invention is not limited to specific fabrics or yarns, or does not need use of specific chemical agents, in contrast to the above-identified conventional processes. Furthermore, since the adhesive tape or tapes is/are used on the back or inside surfaces of the trousers, the outside appearance of the trousers is not adversely affected by the use of the adhesive tape or tapes.

Thus, the trousers in accordance with the present invention enjoys durable crease lines which are easily and freely set therein without being limited to specific fabrics, yarns, or dyes or without resulting in any loss of the commercial value due to the discoloration, lowered visual appearance, etc.

In a preferred embodiment of the present invention, the at least one adhesive tape comprises two two-surface adhesive tapes each of which has two opposite adhesive surfaces, one of the two adhesive surfaces of each of the two two-surface adhesive tapes being adhered to the inner surface of a corresponding one of the two side portions over the entire length of the corresponding one side portion, the other adhesive surfaces of the two two-surface adhesive tapes being adhered to each other so as to connect the inner surfaces of the two side portions to each other. In this case, the two side portions on both sides of the crease line are adhered to each other with increased forces. Thus, the two side portions which cooperate with each other to define the crease line is more effectively prevented from opening due to the tensile forces exerted thereto while the trousers are worn on the user. Consequently, the crease line is kept sufficiently neat for a still longer period of use. Each of the two two-surface adhesive tapes may be constituted by a heat-sensitive adhesive tape. In this case, the two side portions adjacent to the crease line are thermally adhered to each other by ironing or steaming the adhesive tapes. Thus, the present trousers are effectively prevented from having wrinkles or corrugations due to the adhesion of the adhesive tapes to the two side portions.

BRIEF DESCRIPTION OF THE DRAWINGS

The above and optional objects, features, and advantages of the present invention will be better understood by reading the following detailed description of the presently preferred embodiments of the invention when considered in conjunction with the accompanying drawings, in which.

DETAILED DESCRIPTION OF THE PREFERRED EMBODIMENTS

Figure 1:
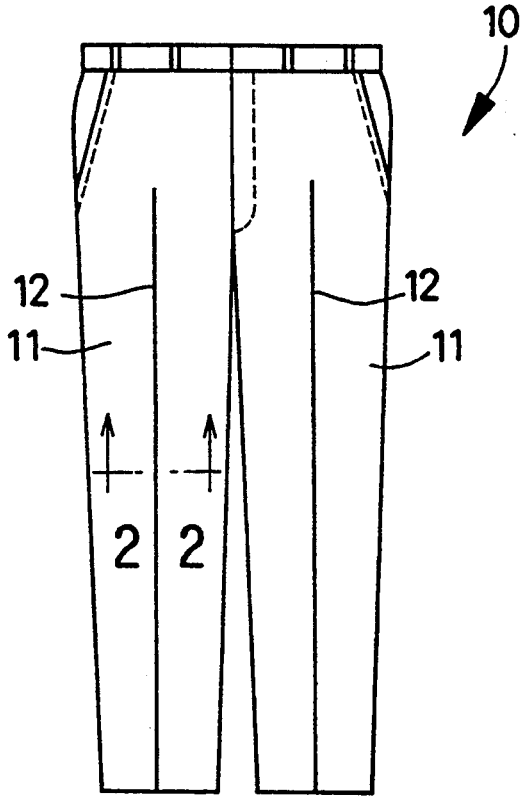
FIG. 1 is a front view of a pair of trousers embodying the present invention.

Referring first to FIG. 1, there is schematically illustrated a pair of trousers 10 made purely of wool (i.e., 100% wool fabric or yarn). The trousers 10 includes two leg coverings 11, 11 for covering two legs of a wearer, respectively. Each of the two leg coverings 11, 11 includes a front half and a rear half (not shown). Each of the front and rear halves is creased at the middle thereof to have a continuous straight crease line 12 extending over an entire, vertical length thereof. The crease line 12 is set in each of the two halves of each of the two leg coverings 11, 11. One of the conventional processes is employed for setting the crease lines 12 in the trousers 10.

Figure 2:
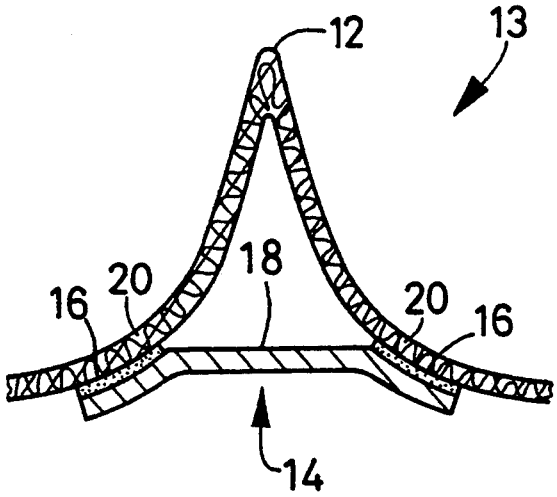
FIG. 2 is an enlarged cross-sectional view of a leg covering of the trousers of FIG. 1, taken along lines 2—2 in FIG. 1.

FIG. 2 shows an enlarged cross-sectional view of the neighborhood of one of the crease lines 12 of the leg coverings 11, 11 of the trousers 10. As illustrated in the figure, each of the crease lines 12 is defined by the top of a corresponding crease 13 having a generally V-shaped cross section and protruding frontward or rearward by a prescribed distance from the remaining of the front or rear half of a corresponding leg covering 11.

An adhesive tape 14 having a prescribed width is adhered to the inner surface of each half of each leg covering 11. Specifically, the adhesive tape 14 includes two adhesive end areas 16, 16 and one non-adhesive intermediate area 18 between the two adhesive end areas 16, 16 in a direction of width of the tape 14. Each adhesive end area 16 includes an adhesive material impregnated therein. Each half of each leg covering 11 includes two side portions 20, 20 respectively located on both sides of the crease line 12, and the two adhesive end areas 16, 16 of the adhesive tape 14 are adhered to respective inner surfaces of the two side portions 20, 20 over the entire length of the side areas 20, 20 along the crease line 12, such that the non-adhesive intermediate area 18 of the adhesive tape 14 is spaced apart from the crease line 12 by the above-described prescribed distance of protrusion. Thus, the non-adhesive intermediate area 18 of the adhesive tape 14 cooperates with respective non-adhered areas of the two side portions 20, 20 which areas are opposed to the non-adhesive intermediate area 18, to define a prismatic space having a generally triangular cross section and extending along the entire length of the crease line 12. The adhesive tape 14 has a length substantially the same as that of the crease line 12, so that the adhesive tape 14 connects, in the above-described manner, between the inner surfaces of the two side portions 20, 20 continuously over the entire length of the side portions 20, 20. The two adhesive end areas 16, 16 are heat-sensitive, and are thermally adhered to the two side portions 20, 20 by using, e.g., a steam iron.

In this way, the two side portions 20, 20 of each half of each leg covering 11 are connected to each other over the entire vertical length thereof via the two adhesive end areas 16, 16 of the adhesive tape 14, such that the two side portions 20, 20 are spaced apart from each other by a distance generally equal to the width of the non-adhesive intermediate area 18 of the adhesive tape 14. Consequently, the two side portions 20, 20 on both sides of the crease line 12 are effectively prevented from opening in a direction in which the side portions 20, 20 become more distant.

When the pair of trousers 10 are being worn on a wearer, tensile forces are exerted to the crease lines 12 or creases 13 in directions in which the two side portions 20, 20 become more distant from each other, i.e., the distance between the two side portions 20, 20 are increased. However, as described above, the creases each having the V-shaped cross section are effectively prevented from opening widely due to such tensile forces. Thus, the trousers 10 are free from the problem that the creases 13 or crease lines 12 get out of shape or erase, even though the times of wearing of the trousers 10 are increased. Thus, the trousers 10 can be worn many times with the crease lines 12 or creases 13 being kept sufficiently neat.

Since, in the trousers 10, the cubic space having the triangular cross section is defined in rear of each of the crease lines 12, the inner surface of a corresponding crease 13 is effectively prevented from directly contacting the skin of a corresponding leg of the wearer. Therefore, the trousers 10 are free from the problem that the creases 13 or crease lines 12 get out of shape or erase because of sweat, body temperature, etc. of the wearer.

Furthermore, in the trousers 10, each crease 13 or crease line 12 is created simply by adhering the adhesive tape 14 to the inner surfaces of the two side portions 20, 20 adjacent the crease line 12. Thus, in contrast to the trousers produced by any of the conventional processes, durable creases are easily created in the trousers 10, irrespective of what sort of fabrics, yarns, and/or dyes is/are used for producing the trousers 10.

Additionally, since the adhesive tapes 14 are adhered to the inside surfaces of the leg coverings 11, 11, the outside appearance of the trousers 10 is kept intact. The crease lines 12 each defined by the top of the cubic crease 13 having the triangular cross section are well kept in shape during use of the trousers 10, so that they give excellent appearance to the trousers 10.

Figure 3:
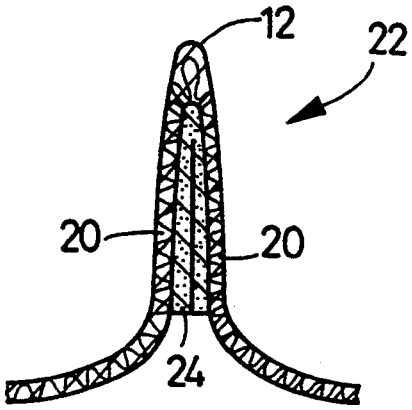
FIG. 3 is a view corresponding to FIG. 2, of another embodiment of the present invention.

Referring next to FIG. 3 corresponding to FIG. 2, there is shown a different pair of trousers 22 as a second embodiment of the present invention. The same reference numerals as used for the trousers 10 as the first embodiment, are used for designating the corresponding parts of the trousers 22, and description of those parts is omitted. While, in the first trousers 10, the two side portions 20, 20 on both sides of each crease line 12 are connected to each other by the adhesive tape 14 having the two adhesive end areas 16, 16 in one of two opposite major surfaces thereof, two side portions 20, 20 adjacent each crease line 12 of the present trousers 22 are connected to each other by a heat-sensitive two-surface adhesive tape 24 whose opposite major surfaces provide two adhesive surfaces. The two-surface adhesive tape 24 is, for example, constituted by a nylon tape having two adhesive surfaces.

The heat-sensitive adhesive tape 24 is positioned in rear of each crease line 12 such that one of the two adhesive surfaces of the adhesive tape 24 is opposed to respective inner surfaces of the two side portions 20, 20 adjacent the crease line 12 over a prescribed width and an entire length of each of the side portions 20, 20. The adhesive tape 24 has a length substantially the same as that of the crease line 12. Under the condition that the two side portions 20, 20 are opposed to each other on both sides of the crease line 12 and the other adhesive surface of the adhesive tape 24 are folded into two halves so as to be opposed to each other, heat is applied to the adhesive tape 24 by using, e.g., a steam iron, so that the two side portions 20, 20 are connected to each other via the heat-sensitive adhesive tape 24.

In the second trousers 22, the two side portions 20, 20 on both sides of each crease line 12 are securely connected to each other. Although tensile forces are exerted to the side portions 20, 20 in the direction of width thereof when the trousers 22 is being worn on a wearer, the side portions 20, 20 are effectively prevented from opening, i.e., being separated from each other.

Since the side portions 20, 20 adjacent each crease line 12 are thermally connected to each other via the heat-sensitive adhesive tape 24 by applying heat using, e.g., a stream iron, undesirable wrinkles are not produced in the side portions 20, 20 of the trousers 22 during the adhesion step.

Figure 4:
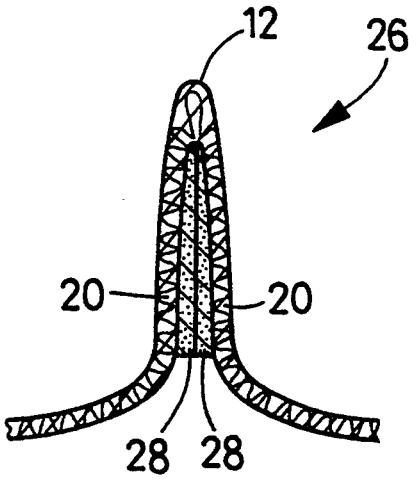
FIG. 4 is a view corresponding to FIG. 2, of yet another embodiment of the present invention.

Referring next to FIG. 4 corresponding to FIGS. 2 and 3, there is shown another pair of trousers 26 as a third embodiment of the present invention. The same reference numerals as used for the second trousers 22 are used for designating the corresponding parts of the third trousers 26, and description of those parts is omitted. While, in the second trousers 22, the inner surfaces of the two side portions 20, 20 on both sides of each crease line 12 are connected to each other by the single heat-sensitive two-surface adhesive tape 24 having the prescribed width, two side portions 20, 20 adjacent each crease line 12 of the third trousers 26 are connected to each other by two heat-sensitive two-surface adhesive tapes 28, 28. Each of the two heat-sensitive adhesive tapes 28, 28 is, for example, constituted by a tape identical with the adhesive tape 24 used in the second trousers 22.

The two heat-sensitive adhesive tapes 28, 28 are positioned in rear of each crease line 12 such that one of the two adhesive surfaces of each of the two adhesive tapes 28, 28 is opposed to the inner surface of a corresponding one of the two side portions 20, 20 adjacent the crease line 12, over a prescribed width and an entire length of the corresponding side portion 20. The two adhesive tapes 28, 28 have an identical width, and an identical length substantially the same as that of the crease line 12. Under the condition that one of the two adhesive surfaces of each of the two two-surface adhesive tapes 28, 28 is opposed to the inner surface of a corresponding one of the two side portions 20, 20 and that the other adhesive surface of one of the two adhesive tapes 28, 28 is adhered to the other adhesive surface of the other of the two adhesive tapes 28, 28, heat is applied to the two adhesive tapes 28, 28 by using, e.g., a steam iron, so that the two side portions 20, 20 are thermally connected to each other via the adhesive tapes 28, 28.

In the instant trousers 26, too, the two side portions 20, 20 on both sides of each crease line 12 are securely connected to each other. Therefore, the trousers 26 enjoys the same advantages with the trousers 22 of FIG. 3. In the third trousers 26, in particular, it is ensured that the two side portions 20, 20 adjacent to each crease line 12 are connected to each other over a constant width corresponding to the width of the adhesive tapes 28, 28 along the crease line 12. Therefore, the trousers 26 is free from a problem that the two side portions 20, 20 are not uniformly adhered to each other along the crease line 12, that is, the width of adhesion locally changes along the crease line 12. Consequently, in the trousers 26, the adhered side portions 20, 20 are effectively prevented from corrugating along the crease line 12 and/or peeling at such local portions short of adhesive force.

While the present invention has been described in its preferred embodiments with detailed particulars, it is to be understood that the present invention should not be limited to the particulars of the illustrated embodiments, but may be otherwise embodied.

While, in the first embodiment, the adhesive tape 14 has the non-adhesive intermediate area 18 in addition to the two adhesive end areas 16, 16, it is possible to use, in place of the adhesive tape 14, an adhesive tape which has two adhesive half areas but does not have a non-adhesive area like the intermediate area 18 of the adhesive tape 14 between the two adhesive half areas.

Additionally, the adhesive tape 14 used in the first embodiment is not limited to the illustrated material. It is, however, preferred that the adhesive tape 14 be constituted by a commercially available cloth tape which is freely foldable or creaseable, is of low elongation upon exertion thereto of tensile forces in the direction of width thereof, and is not peeled off due to washing or dry cleaning.

In the first embodiment, the cubic space having the triangular cross section is defined in rear of each crease line 12, and each crease 13 is set such that each crease line 12 is spaced apart by a prescribed distance from the adhesive tape 14 (specifically, non-adhesive intermediate area 18 thereof). The prescribed distance is changeable by taking into consideration the nature and/or thickness of the textile yarn used for producing the fabric of the trousers 10. Generally, it is preferred that the prescribed distance fall within the range of 3 to 20 mm.

Additionally, the width of the non-adhesive intermediate area 18 of the adhesive tape 14 used in the first embodiment, or the width of the heat-sensitive adhesive tape or tapes 24, 28 used in the second or third embodiment may be changed by taking into consideration the nature and/or thickness of the textile yarn used for producing the fabric of the trousers 10, 22 or 26. Generally, it is preferred that each of the above-indicated widths fall within the range of 3 to 30 mm.

While, in the second or third embodiment, the heat-sensitive adhesive tape or tapes 24, 28 is/are constituted by a two-surface adhesive nylon tape, other sorts of two-surface adhesive tapes may be employed.

Further, in place of the adhesive tape or taps 14, 24, 28, it is possible to use a single two-surface adhesive tape of either the heat-sensitive type or non-heat-sensitive type, such that the single two-surface adhesive tape is inserted between the inner surfaces of the two side portions 20, 20 on both sides of each crease line 12. In this situation, each of the two adhesive opposite major surfaces of the tape is adhered to the inner surface of a corresponding one of the two side portions 20, 20, so that the inner surfaces of the two side portions 20, 20 are connected to each other over the entire length of the side portions 20, 20 along each crease line 12.

While, in the illustrated embodiments, the trousers 10, 22, 26 are made purely of wool, i.e., produced using 100% wool fabric or yarn, it is possible to apply the principle of the present invention to other sorts of trousers produced using other fabrics or yarns.

It is to be understood that the present invention may be embodied with other changes, improvements, or modifications that may occur to those skilled in the art without departing from the scope and spirit of the present invention defined in the appended claims.

What is claimed is:

1. A pair of trousers comprising:

two leg coverings adapted to cover two legs of a wearer, respectively, each of said leg coverings including a front and a rear half, at least one of said front and rear halves having a crease line extending over a vertical length thereof, and two side portions extending along said crease line on both sides of the crease line, respectively; and at least one adhesive tape which connects respective inner surfaces of said side portions to each other over an entire length of the side portions along said crease line, so as to prevent the side portions from opening in a direction in which the side portions become more distant, wherein said at least one adhesive tape comprises a single two-surface adhesive tape having two opposite adhesive surfaces one of which is adhered to said inner surfaces of said two side portions over the entire length of the side portions, the other adhesive surface of said two-surface adhesive tape consisting of two halves, said two halves being adhered to each other so as to connect said inner surfaces of the two side portions to each other.

2. The trousers according to claim 1, wherein said single two-surface adhesive tape is constituted by a heat-sensitive adhesive tape.

3. The trousers according to claim 1, wherein the trousers are comprised of wool.

4. A pair of trousers comprising:

two leg coverings adapted to cover two legs of a wearer, respectively, each of said leg coverings including a front and a rear half, at least one of said front and rear halves having a crease line extending over a vertical length thereof, and two side portions extending along said crease line on both sides of the crease line, respectively; and at least one adhesive tape which connects respective inner surfaces of said side portions to each other over an entire length of the side portions along said crease line, so as to prevent the side portions from opening in a direction in which the side portions become more distant, wherein said at least one adhesive tape comprises two two-surface adhesive tapes each of which has two opposite adhesive surfaces, one of the two adhesive surfaces of each of said two two-surface adhesive tapes being adhered to the inner surface of a corresponding one of said two side portions over the entire length of said corresponding one side portion, the other adhesive surfaces of said two two-surface adhesive tapes being adhered to each other so as to connect the inner surfaces of the two side portions to each other.

5. The trousers according to claim 4, wherein each of said two two-surface adhesive tapes is constituted by a heat-sensitive adhesive tape.

6. The trousers according to claim 4, wherein the trousers are comprised of wool.

* * * * *